US008744774B2

(12) United States Patent
Zazovsky

(10) Patent No.: US 8,744,774 B2
(45) Date of Patent: Jun. 3, 2014

(54) CLEANUP PRODUCTION DURING SAMPLING

(75) Inventor: Alexander Zazovsky, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1026 days.

(21) Appl. No.: 12/742,677

(22) PCT Filed: Nov. 10, 2008

(86) PCT No.: PCT/US2008/082988

§ 371 (c)(1), (2), (4) Date: Jul. 27, 2010

(87) PCT Pub. No.: WO2009/064691

PCT Pub. Date: May 22, 2009

(65) Prior Publication Data

US 2010/0294491 A1 Nov. 25, 2010

Related U.S. Application Data

(60) Provisional application No. 60/988,614, filed on Nov. 16, 2007.

(51) Int. Cl.
*E21B 49/08* (2006.01)
*G06G 7/48* (2006.01)

(52) U.S. Cl.
USPC ..... 702/12; 702/6; 702/11; 73/152.24; 73/152.28; 73/152.55; 166/264; 175/48; 175/50; 175/59; 703/10

(58) Field of Classification Search
USPC ..... 702/6, 11, 12; 73/152.24, 152.28, 73/152.55; 166/264; 175/48, 50, 59; 703/10
See application file for complete search history.

(56) References Cited

U.S. PATENT DOCUMENTS

2003/0163259 A1 8/2003 DiFoggio et al.
2006/0000603 A1 1/2006 Zazovsky et al.

FOREIGN PATENT DOCUMENTS

EP 0520903 12/1992
EP 1686238 8/2006

OTHER PUBLICATIONS

Zazovsky, Alexander, Monitoring and Prediction of Cleanup Production During Sampling, SPE 112409, Lafayette, LA, Feb. 13-15, 2008.

*Primary Examiner* — Sujoy Kundu
*Assistant Examiner* — L. Anderson
(74) *Attorney, Agent, or Firm* — Cathy Hewitt

(57) ABSTRACT

Cleanup monitoring and prediction in real time targeting estimation of pumpout volume versus final contamination, including detecting breakthrough of formation fluid to a sampling tool and detecting transition of cleanup regime from a predominantly circumferential cleanup regime to a predominantly vertical cleanup regime. Similar workflow can be employed for estimating contamination at the end of cleanup production for a given pumpout volume.

17 Claims, 12 Drawing Sheets

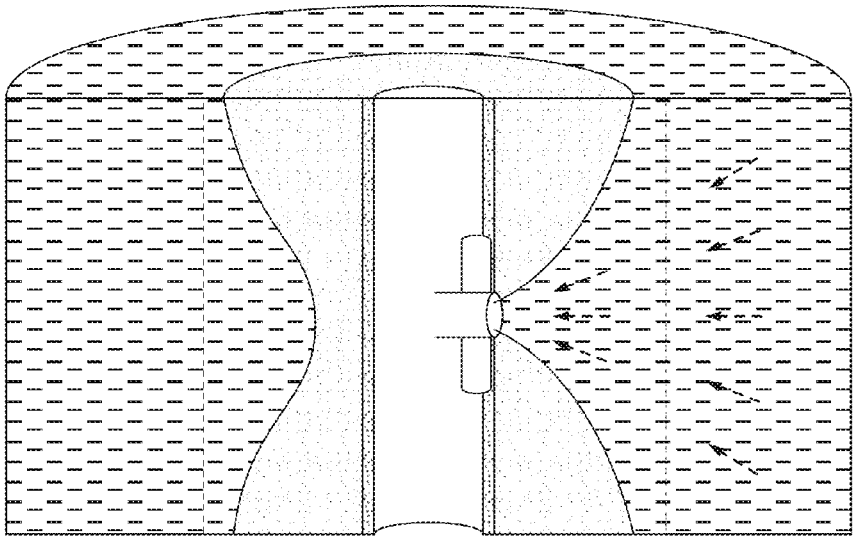
FIG. 3
FIG. 5
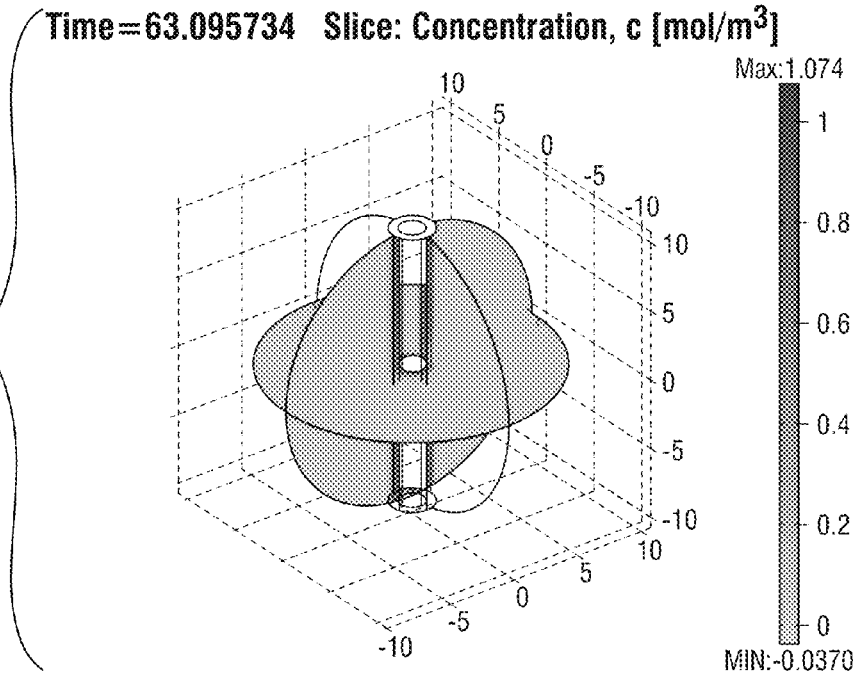

CLEANUP PRODUCTION DURING SAMPLING

FIELD OF THE DISCLOSURE

The present disclosure relates to techniques for the cleanup of contaminated formation fluid during sampling operations. More particularly, the present disclosure relates to predicting cleanup parameters during sampling operations.

BACKGROUND OF THE DISCLOSURE

Formation fluid sampling by Wireline Formation Tester (WFT) during drilling operation represents an important component of the formation evaluation system established by the petroleum industry, especially when it deals with high profile and offshore wells. It is well known that the errors in estimates of formation fluid properties can lead to significant miscalculations in design and performance prediction of flow assurance, well construction, and production facilities. The main challenge in obtaining representative samples of formation fluid by WFT is related to the mud filtrate invasion during drilling. After a few hours of drilling, the borehole is usually surrounded by the invasion zone saturated predominantly with mud filtrate and, for this reason, any sampling operation launched during interruption of drilling has to start from the cleanup production, which continues until the target of contamination tolerance is reached or the time allocated for the sampling operation has run out. The major challenge of cleanup production monitoring represents the case of drilling with oil-based mud (OBM) due to miscibility of OBM filtrate with formation hydrocarbons and poor resistivity contrast.

The variation of formation fluid properties during cleanup production, however, can be reliably detected by optics. Existing Optical Fluid Analyzers (OFA) can measure the optical density (OD) of produced mixtures in a wide spectrum of invisible light with the wavelengths in the range from 400 nm to 2200 nm. In presence of initial OD contrast between the OBM filtrate and the formation fluid, the high sensitivity of optical measurements to the composition of produced fluid can be observed. This sensitivity, however, does not allow for the quantification of contamination in the produced fluid, since the OD of virgin formation fluid is unknown in advance. To compensate for the lack of information during cleanup production monitoring, the contamination transport prediction has to be involved to achieve the closure of optical monitoring model.

Although advanced sampling operations with optical contamination monitoring have been used by the industry for more than ten years, the contamination transport modeling for cleanup prediction is still in its rudimentary phase. The approach to the contamination transport during cleanup production, which is currently considered as state of the art by the industry, is based on the empirical model for the contamination evolution with time during the late phase of cleanup. This model states that the contamination, defined as the concentration of mud filtrate in the produced fluid, has to decrease with time as $t^{-5/12}$. This behavior contradicts the analytical model, which is based on the pseudo-spherical flow and contamination transport, predicting faster decay of contamination $\eta$ with time, namely as $t^{-2/3}$. Recently, the numerical simulations have confirmed the empirical law, $\eta \sim t^{-5/12}$, but have not explained the existing contradiction between the theory and field observations.

SUMMARY OF THE DISCLOSURE

A novel concept for cleanup prediction during sampling is proposed. This concept shifts focus to the early phase of cleanup, allowing for early predictions of pumpout time or produced volume using optical fluid analysis logs versus given contamination targets. The early phase of cleanup potentially provides a great deal of information to be used in prediction of cleanup, because this phase is strongly affected by both the local flow pattern and the contamination transport and deals with a larger range of optical density variation.

A new approach to cleanup prediction is based on a truly three-dimensional (3D) model of flow and contamination transport to the probe production area at the wellbore wall covered by mudcake. This model better captures the initial phase of cleanup than the conventional spherical flow model, which incorporates axisymmetrical contamination transport to a small production sphere located at the wellbore axis.

The new model provides the signature of 3D contamination transport on cleanup dynamics, which is controlled by the ratio of invasion depth to wellbore radius. The analysis of new problem solutions reveals new details of cleanup evolution. In particular, the transition from a predominantly circumferential regime of cleanup to a predominantly vertical cleanup has a distinctive signature that can be used in cleanup progress monitoring and the reconstruction of initial invasion depth.

Examples of sampling job data processing that support the new concept are provided. They indicate that decent estimates of pumpout volumes can be obtained 3-5 times earlier using the new approach.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 3 is a schematic of contamination transport.

FIGS. 5 and 6A-6D illustrate results of the cleanup production simulation using the model of FIGS. 4A and 4B according to one or more aspects of the present invention.

DETAILED DESCRIPTION

Figure 1:
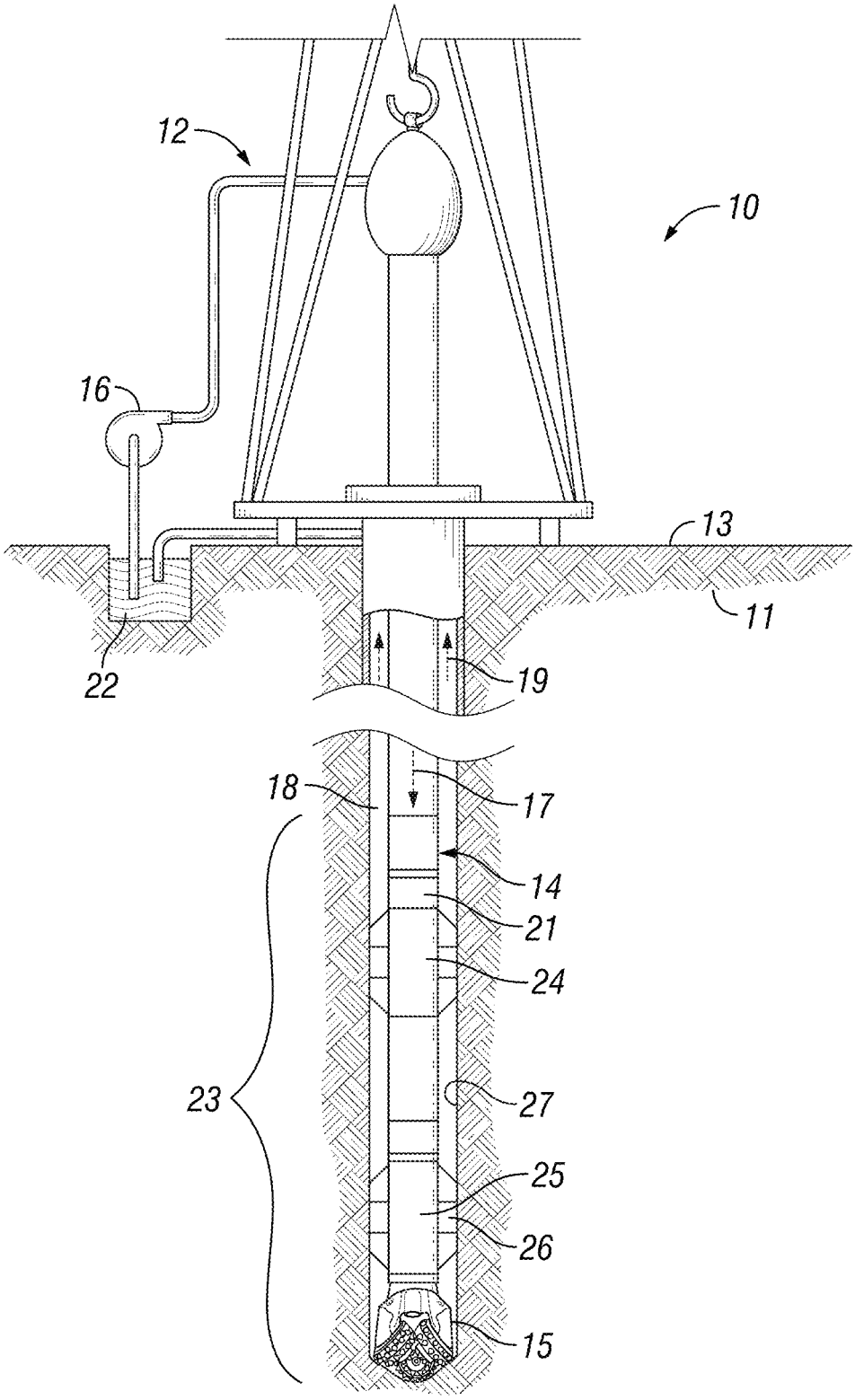
FIG. 1 illustrates an example drilling system used to drill a well through a subsurface formation according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 illustrates a drilling system 10 used to drill a well through subsurface formations, shown generally at 11. A drilling rig 12 at the surface 13 is used to rotate a drill string 14 that includes a drill bit 15 at its lower end. As drill bit 15 is being rotated, a "mud" pump 16 is used to pump drilling fluid, commonly referred to as "mud" or "drilling mud," downward through the drill string 14 in the direction of the arrow 17 to the drill bit 15. The mud, which is used to cool and lubricate the drill bit, exits the drill string 14 through ports (not shown) in the drill bit 15. The mud then carries drill cuttings away from the bottom of the borehole 18 as it flows back to the surface 13 as shown by the arrow 19 through the annulus 21 between the drill string 14 and the formation 11. While a drill string 14 is shown in FIG. 1, it will be noted here that this disclosure is also applicable to work strings, pipe strings, coiled tubing, and wireline conveyed tools, among others. At the surface 13, the return mud is filtered and conveyed back to a mud pit 22 for reuse. The lower end of the drill string 14 includes a bottom-hole assembly (BHA) 23 that includes the drill bit 15, as well as a plurality of drill collars 24, 25 that may include various instruments, such as logging-while-drilling (LWD) or measurement-while-drilling (MWD) sensors and telemetry equipment. A formation evaluation while drilling instrument may, for example, also include or be disposed within a centralizer or stabilizer 26.

A probe may be located on or in the stabilizer 26 for contacting the wellbore wall 27, or may be located in a probe module as part of the BHA. Alternatively, packers may be used. Those having ordinary skill in the art will realize that a formation probe could be disposed in other locations without departing from the scope of this disclosure. At least portions of the current approach may be particularly relevant for LWD or MWD sampling, as this type of tool usually encounters a shallow depth of invasion of the filtrate fluid. In particular, formulas and models for calculating contamination levels in a wireline tool or environment may be different from the formulas and models for calculating contamination levels in an LWD or MWD tool or environment, as the depth of invasion of the filtrate fluid in a wireline environment is much more significant (due to longer exposure periods). It will further become apparent from the below disclosure that an early estimation of contamination levels, important in an LWD or MDW environment, may be made.

The current approach to contamination monitoring during cleanup production is based on the multichannel measurements of optical density of produced fluid. In the presence of optical density contrast between virgin formation fluid and OBM filtrate, invaded in the formation during drilling, the variation of optical density provides indication of progress in mud filtrate displacement by formation fluid. It is not easy, however, to quantify this information by converting it into the contamination of produced fluid. The main difficulty lies in the fact that the composition of virgin formation fluid is unknown in advance and cannot be determined with currently available technology during cleanup production, making it impossible to determine the amount of mud filtrate produced with the reservoir fluid.

The quantification of optical density measurements during cleanup production, however, becomes possible if the information about the flow pattern and contamination transport in the reservoir is involved into interpretation. Unfortunately, the accurate solutions for the cleanup production through a probe or a packed off interval are not easily available and, for this reason, approximate solutions are used instead. These solutions are based on simplifications of flow pattern geometry, fluid properties, and fluid displacement mechanisms. They usually do not capture the short term cleanup evolution, but provide some insight into its long term scenario, which is determined by the far field contamination transport. The model of spherical flow to a small production sphere in the absence of viscosity contrast between the formation fluid and mud filtrate is an example of such an approximate solution.

The information required for the optical model closure can be reduced to a single function, which is the variation of contamination $\eta$ with time t or produced volume V. For the spherical flow model of piston-like displacement without viscosity contrast, the evolution of contamination during final phase of cleanup is described by the power law with two parameters:

$$\eta(t) \approx Bt^{-\alpha},\ t \to \infty \tag{1}$$

The parameter B depends on the production rate and the depth of invasion, whereas the exponent $\alpha$ is determined by the far-field geometry of flow pattern. For the spherical flow, one has $\alpha=2/3$. The different value $\alpha=5/12$ is claimed to be more consistent with the field data and it is used in the existing interpretation suites supporting monitoring and visualization of optical data during sampling operations.

The relationship between the optical density OD and the contamination $\eta$ can be obtained from an empirical relationship between the absorption of light by fluid and the fluid composition, which is known in optics as the Beer-Lambert law. With application to mixtures of reservoir oil or gas and OBM filtrate, the Beer-Lambert law states that the optical density of a mixture OD can be expressed through the optical densities of its components $OD_O$ and $OD_F$ as $$OD = cOD_F + (1-c)OD_O$$

Here, c is the molar concentration of OBM filtrate in mixture. For simplicity, we assume below that the molar concentration c is equal to the volumetric concentration of mud filtrate and therefore the contamination $\eta(t)$ can be expressed through the measured optical density of produced fluid OD(t) as:

$$\eta(t) = [OD_O - OD(t)]/[OD_O - OD_F] \tag{2}$$

Both individual optical densities, $OD_O$ and $OD_F$, are usually unknown, however, the optical density of widely used OBM based fluids is of the order 0-0.1, i.e., the OBM filtrates are almost fully transparent to light.

Since the optical density of formation oil $OD_O$ cannot be reliably determined until a clean sample of oil is recovered, the contamination cannot be estimated through the optical density measurements using only Eq. (2). This uncertainty, however, can be reduced by using the asymptotic solution for the variation of contamination with time of Eq. (1). Substituting Eq. (1) into Eq. (2), one finds that the expression for the measured optical density of produced mixture at long times is:

$$OD(t)=a-bt^{-\alpha},\ a=OD_O,\ b=B(OD_O-OD_F),\ t\rightarrow\infty \quad (3)$$

Eq. (3) can be used for fitting to measured optical density data by determining appropriate parameters a and b. Consequently, the optical density of reservoir oil $OD_O$ becomes known and the evolution of contamination with time, which is determined by Eq. (1) with the parameter $B=b/(OD_O-OD_F)$, is fully calibrated. For a given contamination target $\eta_0$, the time of cleanup production can then be estimated as:

$$t_0\approx(B/\eta_0)^{1/\alpha} \quad (4)$$

Analysis of this formula, however, reveals a deficiency. Indeed, since $1/\alpha=3/2$ or 12/5, the cleanup time estimate $t_0$ should be very sensitive to the parameter $B=b/(OD_O-OD_F)$, which is expressed through the fitting parameters a and b, especially for low contamination targets $\eta_0$. If $\eta_0\rightarrow 0$, small errors in determination of fitting parameters can result in large errors in cleanup time estimates.

Another limitation of the described procedure is related to the fact that it does not allow for quick cleanup time estimates due to the asymptotic nature of Eq. (1) and Eq. (2). A relatively long sequence of cleanup history has to be accumulated before any prediction can be made. The practical requirements, unfortunately, are completely different in a sense that the pumping time estimates are needed as soon as possible, e.g., preferably just after the breakthrough of virgin formation fluid to the probe. The solutions for early phase of cleanup, however, are not available and the pumping time estimates, which would be based on early cleanup monitoring data, still represent the main challenge during sampling operation. Obviously, this limitation can be removed by creating simulation capabilities for realistic flow and contamination transport patterns.

Despite a great success of formation fluid sampling technology, one has to recognize that the currently implemented system of cleanup monitoring is basically qualitative rather than quantitative. Usually, it provides excessively large estimates for cleanup time. These estimates can also be inaccurate and unreliable, especially for sampling jobs under challenging conditions, or trivial if the cleanup is essentially completed. The current technique of cleanup time estimating does not use a full set of optical data obtained during cleanup monitoring except in its late sequences, leading to longer rig times for sampling operations.

A new concept of cleanup monitoring and optical data interpretation, introduced herein, is free of many of the limitations described above. Its relevance and timing matches the industry needs in optimization of sampling operations, especially for drilling environments with severe time constraints.

Figure 2:
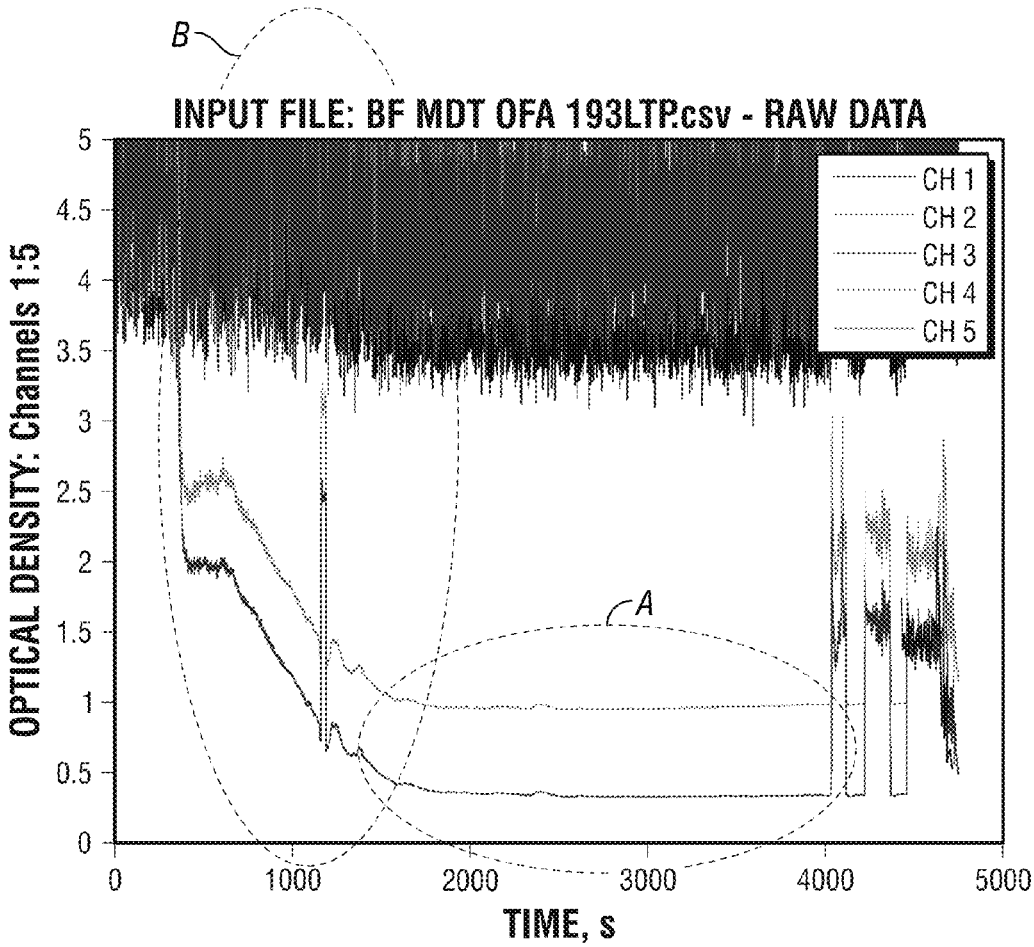
FIG. 2 illustrates an example of optical density measurements used for cleanup monitoring according to one or more aspects of the present disclosure.

An example of OD measurements used for the cleanup monitoring is shown in FIG. 2. These data represent the OD measured in five selected channels of multichannel OFA. They are usually visualized on a monitoring screen in real time as vertical multicolumn plots of selected ODs versus the elapsed time of pumping out in seconds.

Since the OD contrast between OBM filtrate and formation fluid is usually unknown in advance, different OFA channels with pre-selected wavelengths of light can be used for the most sensitive monitoring of cleanup production. The plotted data in FIG. 2 allow for recognizing three distinctive phases of cleanup production. The initial phase, which lasts in this example for about 350 s, usually corresponds to the pumping mud and filtrate. The second phase starts when the OD (in channels 4 and 5 in FIG. 2) steeply drops and then stabilizes, indicating that the breakthrough of formation fluid to the probe has occurred. This phase continues until about 1600 s of elapsed time and ends when the OD reaches a plateau. During the third phase of cleanup, the flow pattern and ODs in monitoring channels vary very slowly although the OD logs become less noisy. This late phase of optical monitoring is currently used for the quantitative cleanup progress prediction by fitting Eq. (3) to the smooth part of the OD log, indicated by ellipse A in FIG. 2, and then estimating the pumpout time $t_0$ versus the contamination target $\eta_0$, using Eq. (4).

Despite the solid performance record, the current cleanup monitoring techniques does not use to full extent the information which might be potentially extracted from the OD measurements. For example, the initial segments of OD logs are not involved in the current cleanup monitoring workflow. These early segments of OD data, however, contain information about a major monitoring event related to the breakthrough of the formation fluid to the probe or first hydrocarbon appearance, which is the main signature of the unknown depth of OBM filtrate invasion and the flow pattern. It is worth noting also that the scale of OD variation just after the breakthrough is usually orders of magnitude larger than that during the final phase of cleanup. This part of OD logs is surrounded in FIG. 2 by ellipse B. The duration of the second phase of cleanup may also be considered as a signature of the flow and contamination transport patterns, which should be targeted during cleanup monitoring.

In order to use the initial parts of OD logs for the quantitative cleanup monitoring, the appropriate solutions for the forward problem of contamination transport during cleanup production have to be obtained. This problem, however, represents serious challenges for solving with existing reservoir simulation tools if the full sensitivity analysis with respect to a few unknown parameters has to be carried out in order to provide the basis for the OD log inversion. The schematic of the contamination transport problem is shown in FIG. 3. The pumping out is accomplished through the probe engaged into the mudcake sealing the borehole wall. Initially, the wellbore is surrounded by a cylindrical invasion zone, saturated with OBM filtrate, and only mud filtrate is produced at the beginning of cleanup operation, leading to non-uniform contraction of the invasion zone with pumpout volume. As soon as formation fluid reaches the probe production area, the mixture of mud filtrate and virgin formation fluid is produced. The contamination of formation fluid by mud filtrate usually decreases rapidly just after the breakthrough, and then more slowly resulting in large cleanup production volumes for reaching low levels of contamination.

The numerical simulation of contamination transport has to deal with the geometrical and hydrodynamic singularities of this 3D problem, which has multiple characteristic scales, mixed boundary conditions, strongly non-uniform velocity field, and a moving contamination front. The characteristic scales are represented by the radius of probe production area, $r_P$, which is further referred to as a probe radius, the initial depth of invasion, $d_i$ and the radius of simulation domain, $r_S$. These scales can be different from each other by one order of magnitude, such as where $r_P \ll d_i \ll r_S$. The flow velocity is singular at the boundary of the probe producing area, where the velocity changes direction by 90°. The contamination front is smooth at the beginning but breaks after the breakthrough of formation fluid to the probe moving with time very close to the boundary of probe producing area. The accurate calculation of contamination during late phase of cleanup requires high resolution of numerical modeling near the probe producing area adding another characteristic scale, which can be very small compared to the probe radius. The viscosity contrast between OBM filtrate and formation fluid also contributes to the challenges of numerical modeling. Although a success in cleanup production modeling has been recently reported, it is still a challenging task requiring significant time, special skills, and simulation tools.

Figure 4A:
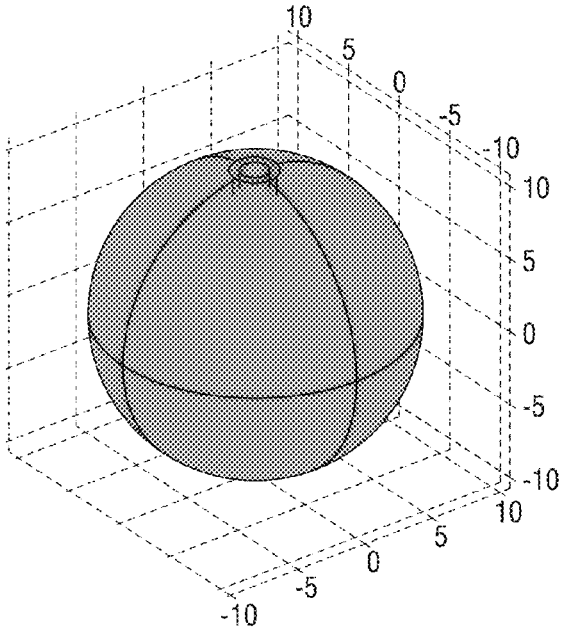
FIGS. 4A and 4B illustrate model details for a cleanup production simulation according to one or more aspects of the present disclosure.
Figure 4B:
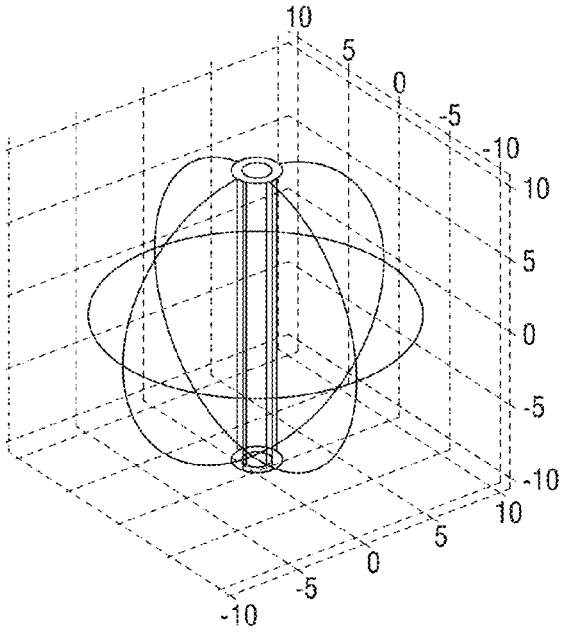
Figure 6A:
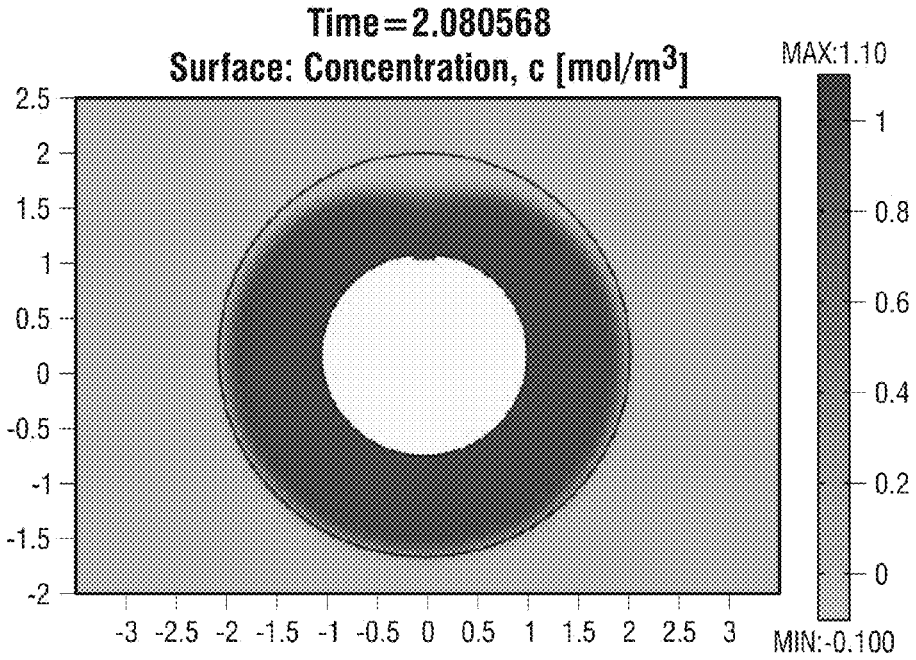
Figure 6B:
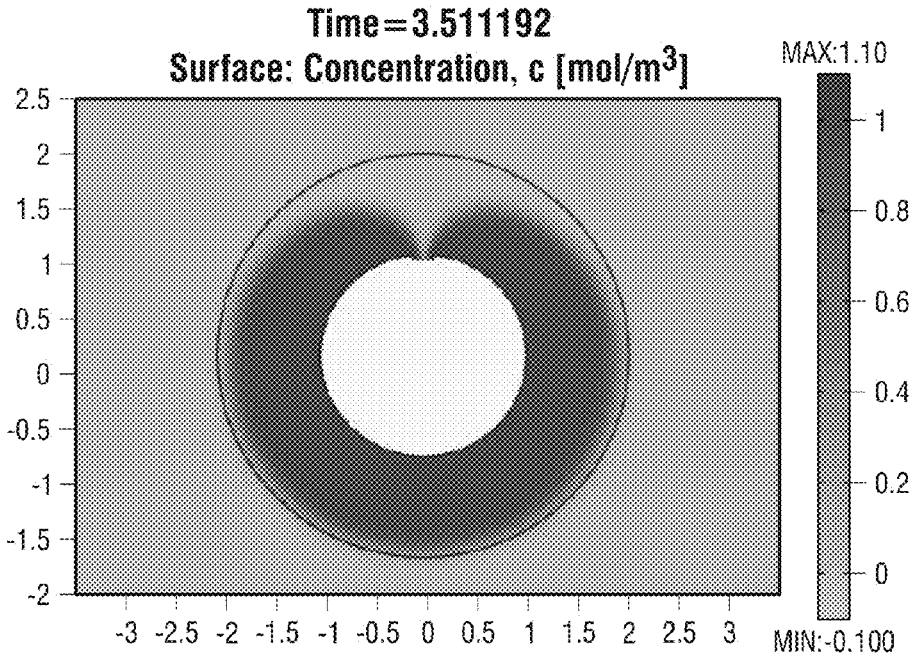
Figure 6C:
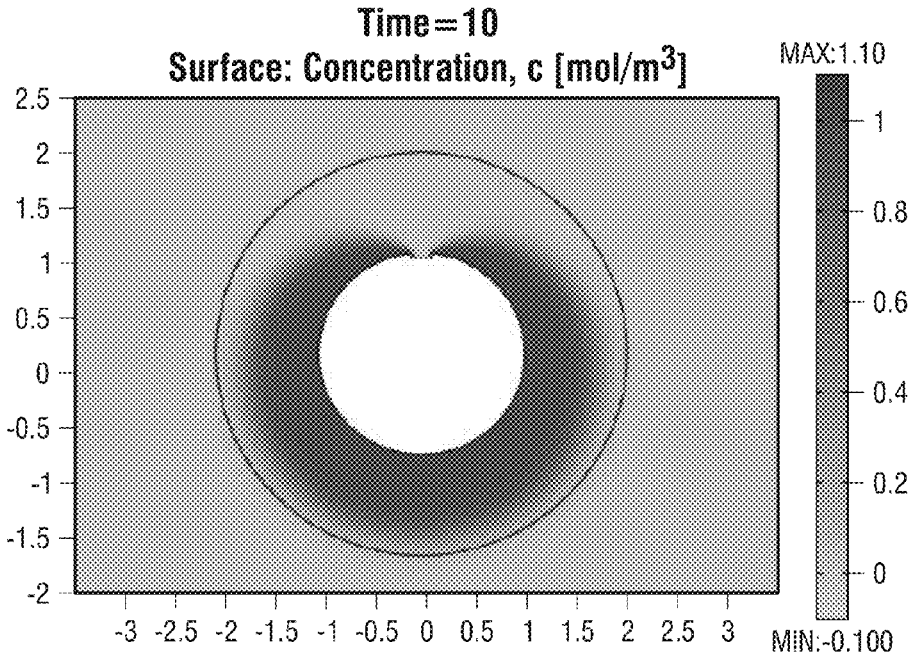
Figure 6D:
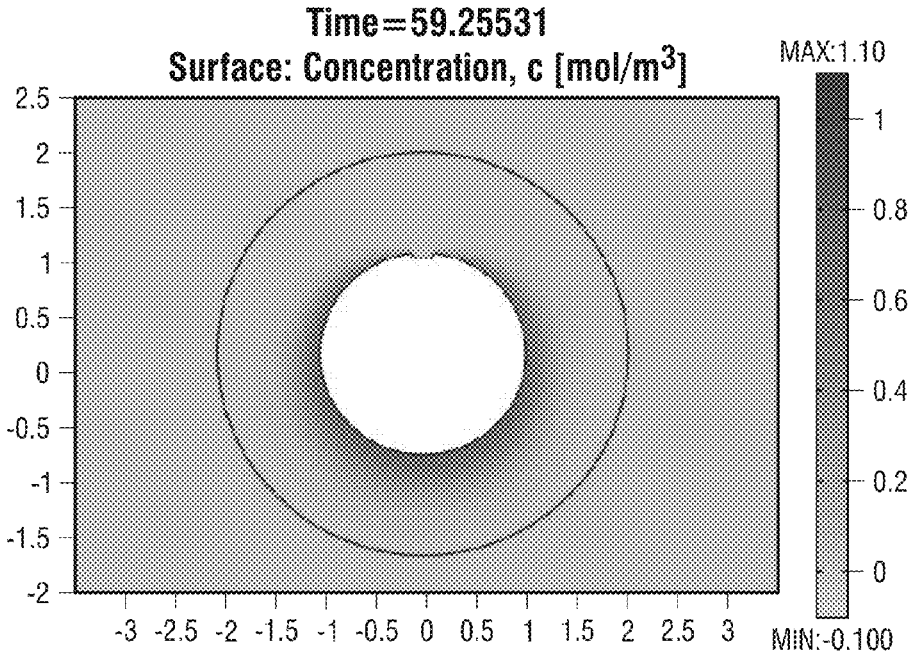

Presented below are the results of cleanup production simulation obtained with the FEM package of Comsol Multiphysics. The model details are shown in FIGS. 4A and 4B. The simulation domain was imbedded into a spherical volume surrounding the borehole with a circular production area representing a probe and a cylindrical invasion zone.

The flow and contamination transport simulation was based on a single-phase flow model of piston-like displacement governed by the Darcy law and the mass conservation equation. The total number of finite elements used during simulations varied between 100,000 and 250,000. The CPU time for a single simulation of cleanup production history was about 1-3 hours on a Dell Precision 670 computer, shorter for a shallow invasion and longer for a deep invasion. The calculations were continued until the contamination of produced fluid reached approximately 2-3%. The example of simulated contamination distribution around a probe is shown in FIGS. 5 and 6A-6D, where the light areas represent the formation fluid and the dark areas represent the OBM filtrate.

Figure 7:
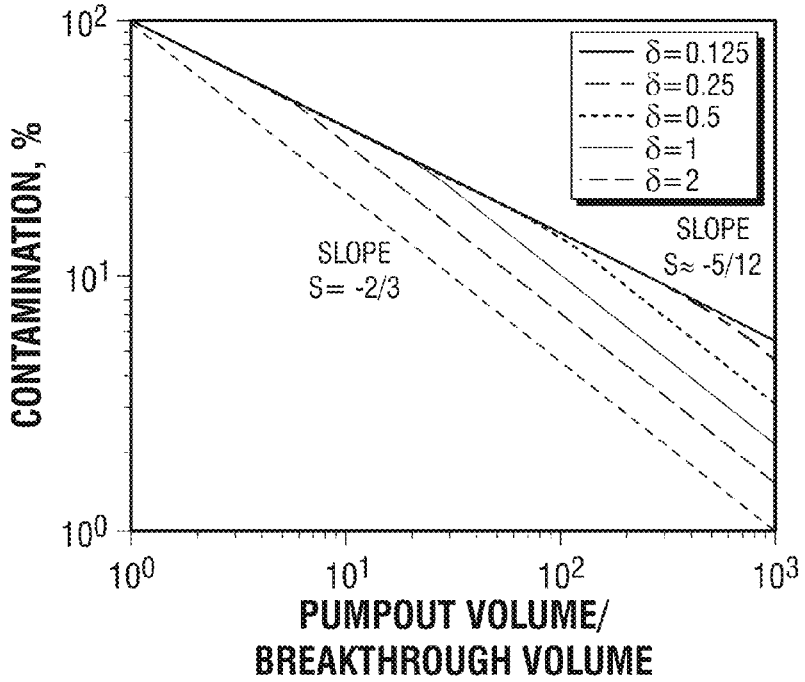
FIG. 7 illustrates the evolution of contamination with produced volume according to one or more aspects of the present disclosure.

The evolution of contamination C (%) with the dimensionless produced volume $\Omega=V/V_{BT}$ is shown in FIG. 7 for the dimensionless invasion depth $\delta=d_i/r_w$ equal to 0.125, 0.25, 0.5, 1 and 2. All of the curves collapse together during the initial phase of cleanup production after the breakthrough of formation fluid to the probe. In logarithmic coordinates ($\log_{10}\Omega$,$\log_{10}$ C), this initial contamination evolution matches the empirical power law $C\sim\Omega^{-\alpha}$ with the exponent $\alpha=5/12$. With time, the cleanup dynamics switches to the power law with the exponent $\alpha=2/3$. The deeper the invasion, the earlier this transition occurs in terms of the dimensionless pumpout volume $\Omega_T=V_T/V_{BT}$ due to rapid increase in the breakthrough volume $V_{BT}$ with the invasion depth. The function $\Omega_T(\delta)$ shown in FIG. 8 has been obtained by finding the intersection of two asymptotes capturing the early and late behavior of contamination.

Similarly, the initial contamination trend continues longer for a shallow invasion. For example, it extends below the contamination level 10% at $\delta=0.25$, which corresponds to the invasion depth of about 1" for the borehole diameter of 8.5". Switching from the initial power law $C\sim\Omega^{-5/12}$ to the spherical flow asymptote $C\sim\Omega^{-2/3}$ reflects the variation of the contamination transport pattern during cleanup production. Initially, the predominant contamination transport occurs circumferentially, as shown in FIGS. 6A-6D, but later the contamination is coming primarily from the top and bottom along the wellbore. The mud filtrate has to travel longer distances in order to reach the probe. This change in contamination transport results in more rapid reduction of contamination with the produced volume compared to the initial phase of cleanup.

The results of simulation can be represented schematically as the map of cleanup regimes versus the pumpout volume and the invasion depth. An example of this map is shown in FIG. 9 for the case of equal viscosities of filtrate and formation fluid. It illustrates two sequential phases of cleanup production, the early phase (X) and the late one (Y), with the transition zone (Z) between them. The analysis indicates that the transition zone is relatively narrow, especially for deep invasion. For this reason, it can be replaced by the transition point $\Omega_T$. In the absence of viscosity contrast, the transition point $\Omega_T$ depends on the dimensionless invasion depth $\delta=d_i/r_w$ as shown FIG. 8.

It is worth noting that the modification of the contamination transport regime during cleanup production from the power law $C\sim\Omega^{-5/12}$ to the power law $C\sim\Omega^{-2/3}$ is a fundamental feature of the solution, which has been overlooked so far. It reflects the physics of contamination transport during cleanup production and creates a robust event, which provides valuable information about the flow pattern for predicting cleanup dynamics. Since the cleanup regime switching occurs relatively early at shallow invasion, the detection of this event, as well as the breakthrough of formation fluid to the probe, should be the primary target during cleanup production monitoring. On the other hand, as indicated by the plot in FIG. 8, the circumferential regime of cleanup cannot be distinguished for the invasion depth deeper than 5 wellbore radii. In this case, the breakthrough of formation fluid to the sampling tool becomes a major monitoring event.

Figure 8:
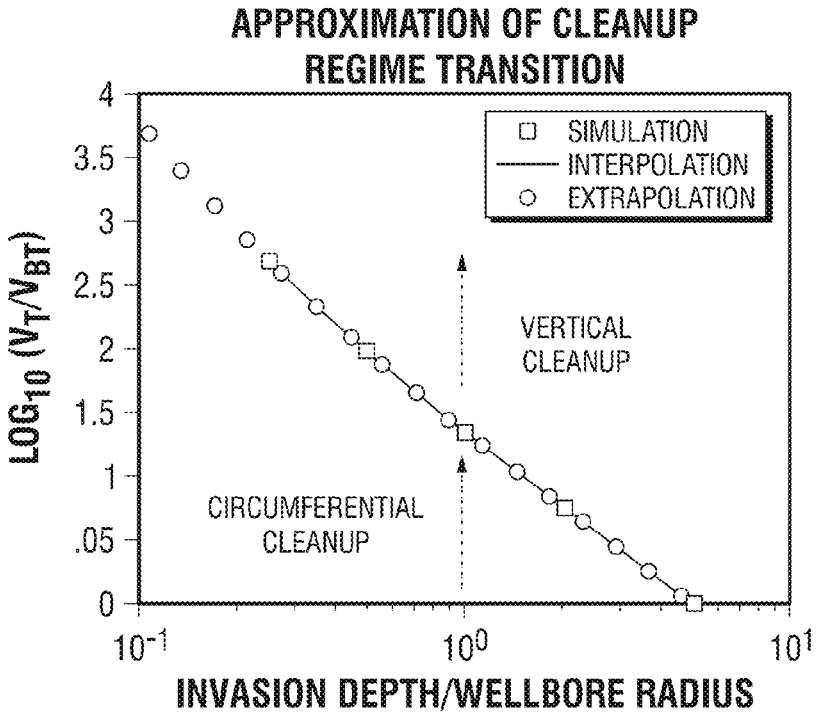
FIG. 8 illustrates cleanup regime transition relative to invasion depth according to one or more aspects of the present disclosure.
Figure 9:
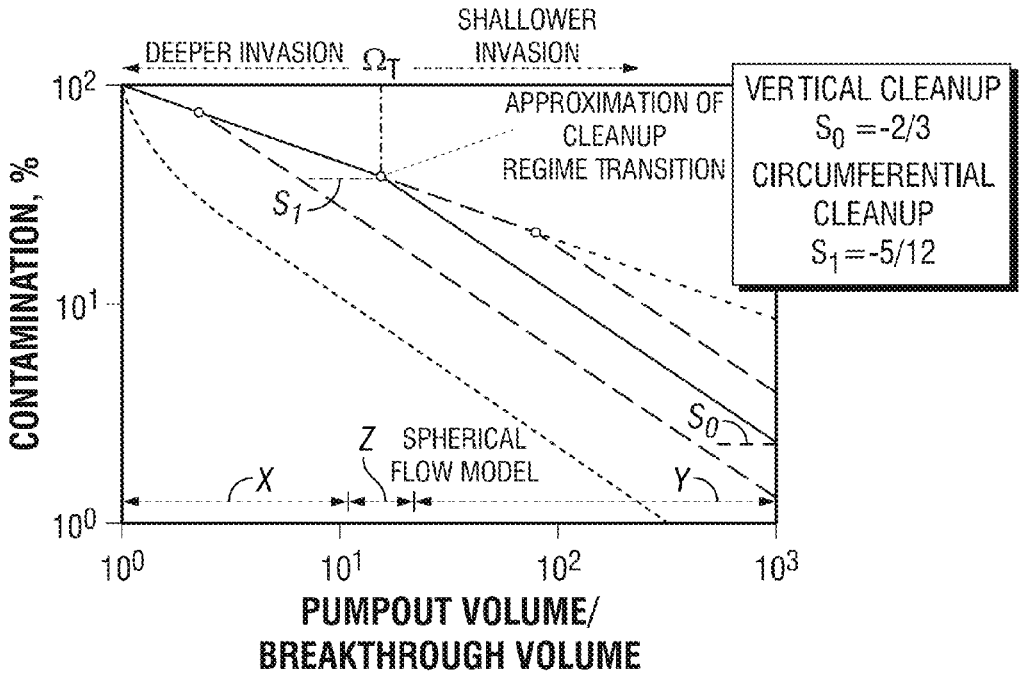
FIG. 9 illustrates an example map of cleanup regimes versus pumpout volume and invasion depth according to one or more aspects of the present disclosure.

The information given in FIG. 8 and FIGS. 4A and 4B allows for representing the contamination C (%) approximately as:

$$C = 100\times\begin{cases}\Omega^{-5/12}, & 1\le\Omega\le\Omega_T(\delta)\\ \Omega_T^{1/4}\cdot\Omega^{-2/3}, & \Omega>\Omega_T(\delta)\end{cases} \tag{5}$$

Figure 10:
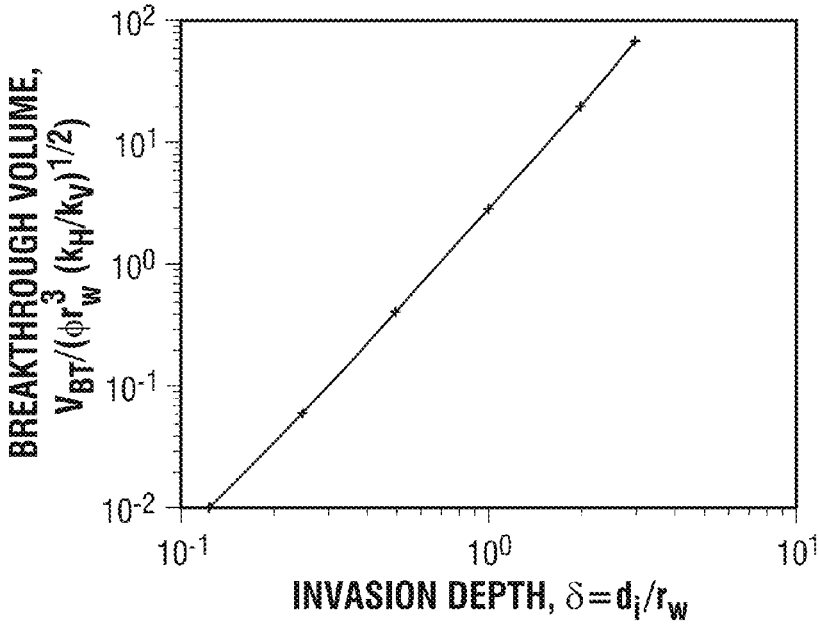
FIG. 10 illustrates breakthrough volume versus invasion depth according to one or more aspects of the present disclosure.

The breakthrough volume, $V_{BT}$, is plotted in FIG. 10 versus the dimensionless depth of invasion $\delta$. It is normalized over the quantity $\phi r_w^3\sqrt{k_H/k_V}$ to take into account the formation porosity $\phi$ and the permeability anisotropy ratio $k_H/k_V$ for a vertical well in the formation with different horizontal and vertical permeabilities. The slope of the curve in logarithmic coordinates is slightly less than 3, since $V_{BT}\sim d_i^3$ for shallow invasion depth if the probe is replaced by a point sink.

Figure 11A:
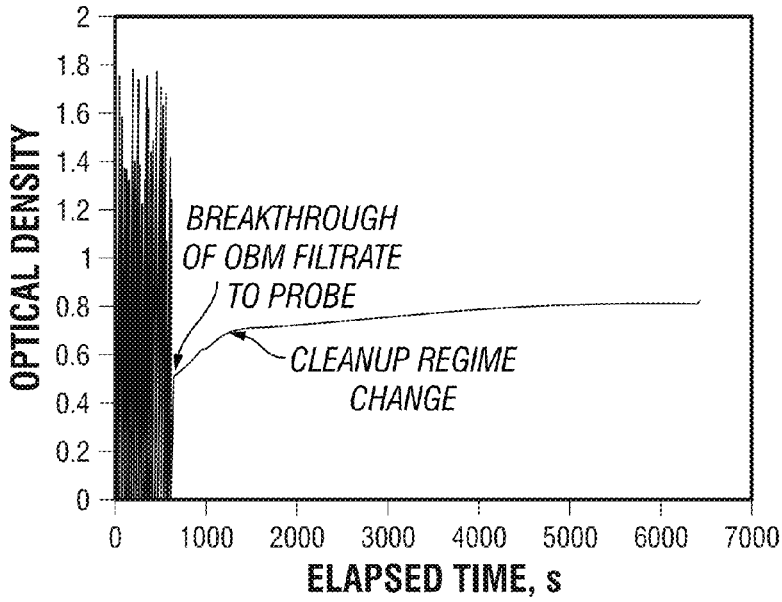
FIGS. 11A and 11B illustrate example optical logs according to one or more aspects of the present disclosure.
Figure 11B:
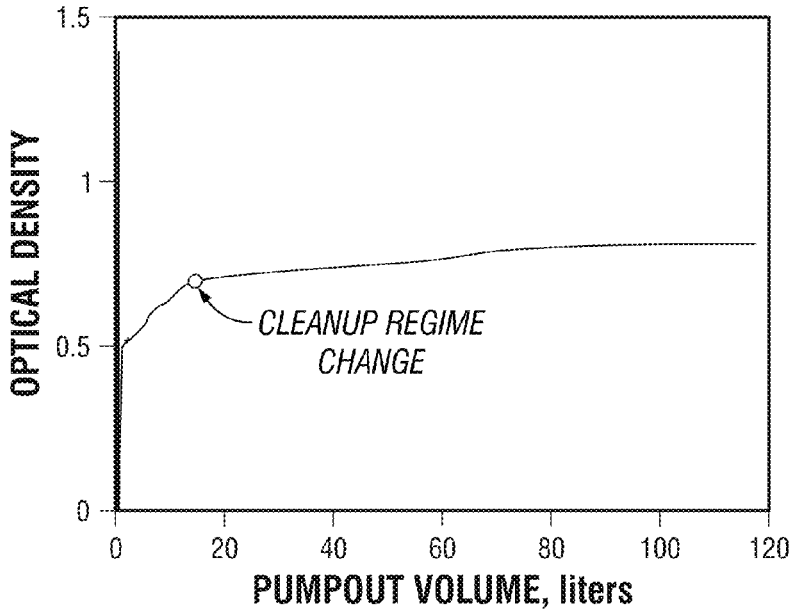

The monitoring technique that can be used for the early prediction of cleanup production is described below assuming relatively shallow mud filtrate invasion, $\delta<5$. It is also assumed that the optical channel, which is used for the cleanup production monitoring, has been already selected. Its OD data allow for distinguishing the formation fluid (oil) from the OBM filtrate. This means that the range of OD variation provides enough resolution for detecting changes in the composition of their mixture. The example of such optical log is shown in FIGS. 11A and 11B. The identified point in FIG. 11B corresponds to the visually detected variation of the slope of OD curve most probably representing switching from the circumferential regime of cleanup to the vertical cleanup.

Figure 12A:
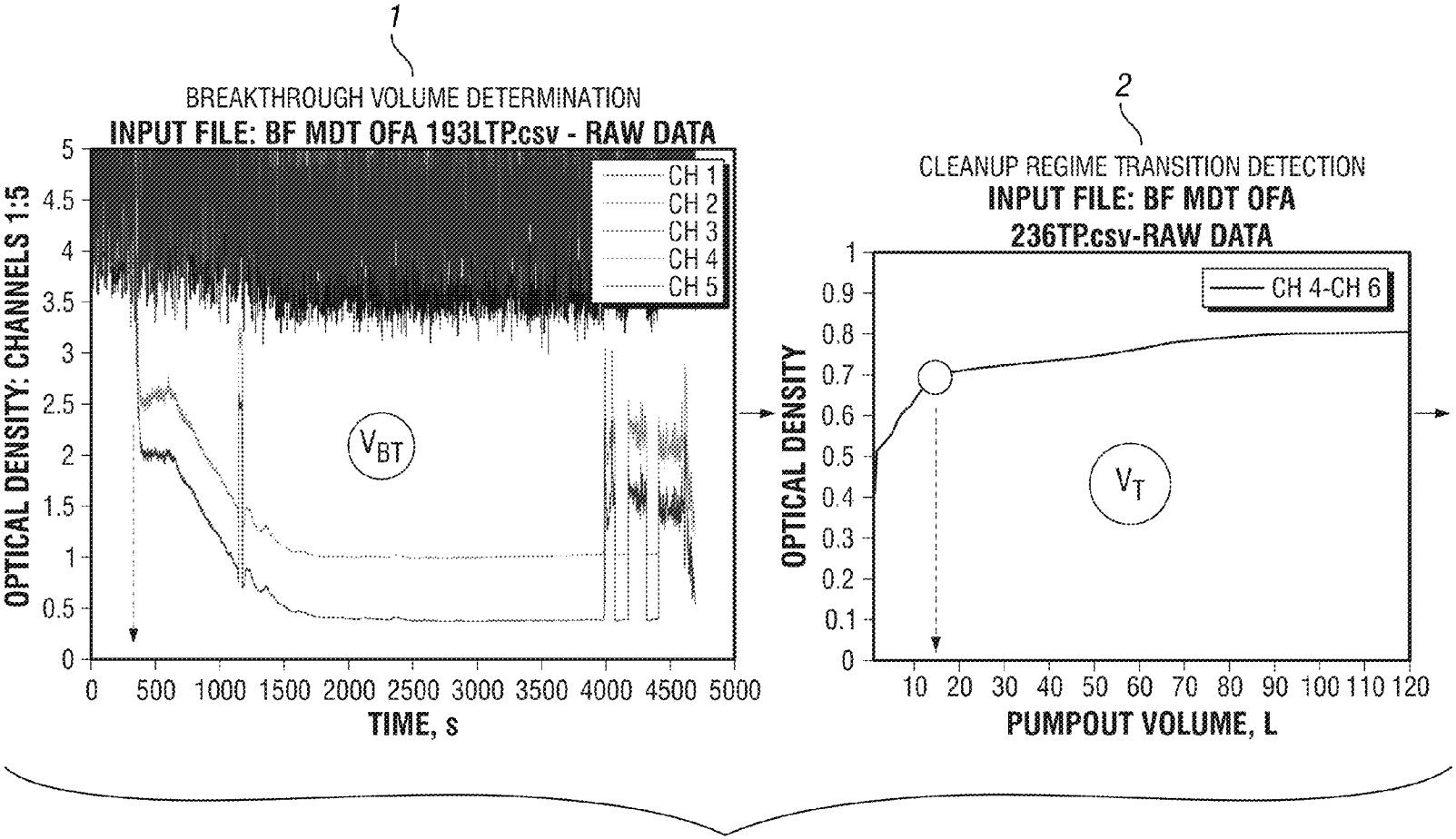
FIGS. 12A, 12B, and 12C illustrate a method according to one or more aspects of the present disclosure.
Figure 12B:
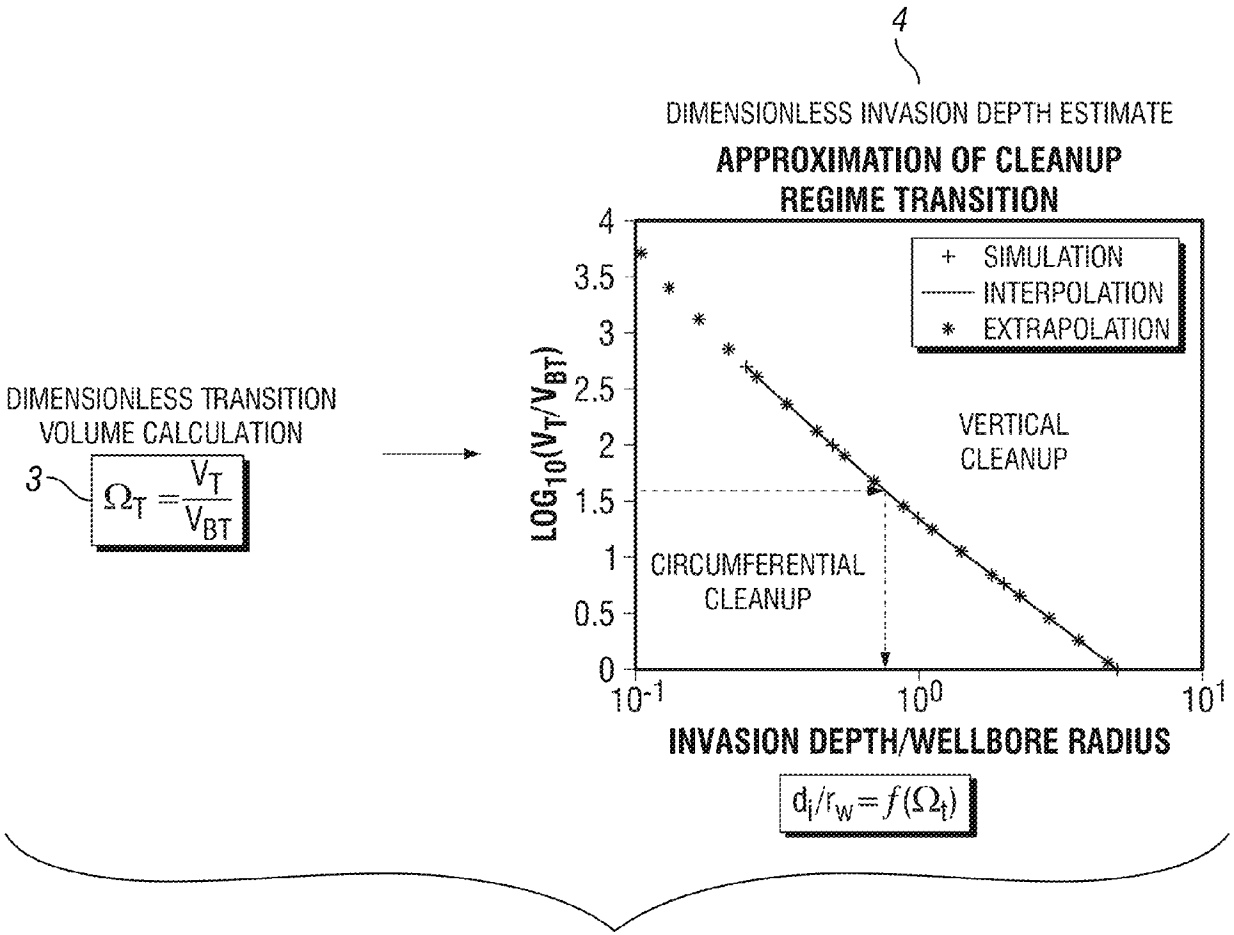
Figure 12C:
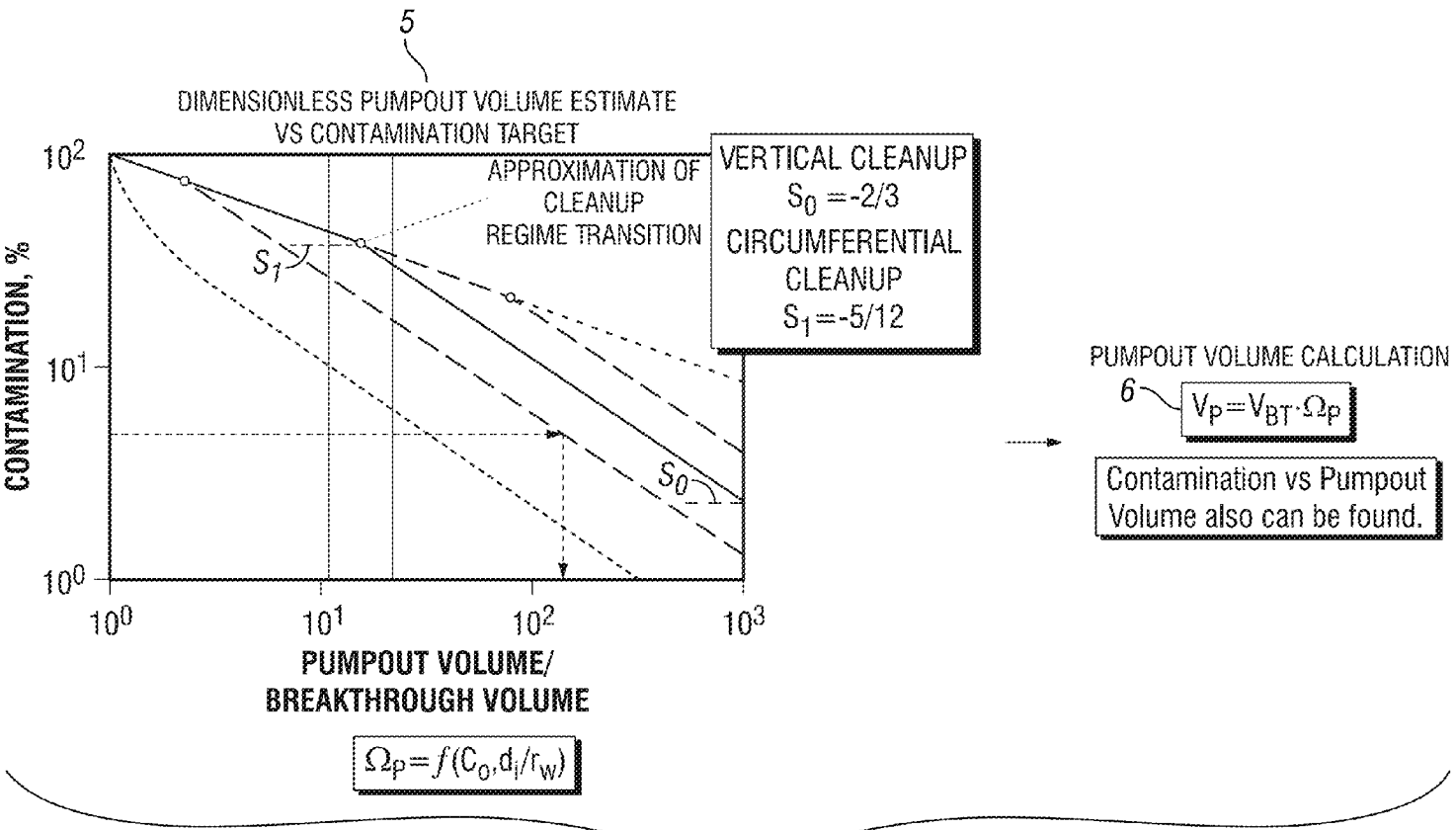

The monitoring technique involves the following six steps, which are also illustrated in FIGS. 12A-12C:

1. The determination of breakthrough production volume $V_{BT}$.
2. The detection of production volume $V_t$ corresponding to the cleanup regime transition.
3. The calculation of normalized production volume at cleanup regime transition $\Omega_T=V_T/V_{BT}$.
4. The estimation of dimensionless invasion depth $\delta=d_i/r_w$, which is matching $\log_{10}\Omega_T$, using the plot in FIG. 8.
5. The estimation of normalized production volume $\Omega_P$ for the given contamination target $C_0$ using the plot in FIG. 9.
6. The calculation of production volume $V_P=V_{BT}\cdot\Omega_P$ corresponding to the contamination target.

FIGS. 12A-12C illustrate a method of cleanup monitoring and prediction in real time targeting estimation of the pumpout volume versus the final contamination according to aspects of the present disclosure. Similar workflow can be employed within the scope of the present application for estimating the contamination at the end of cleanup production for a given pumpout volume.

It is worth noting that this technique of cleanup production monitoring and prediction does not involve any numerical differentiation of noisy data or extrapolation. It is based on the detection of two major events during pumping out. These two events are the breakthrough of formation fluid to the sampling tool and the transition of cleanup regime from predominantly circumferential to vertical. They characterize the flow and contamination transport patterns in the reservoir. The currently available solutions allow for reconstructing the initial depth of invasion in absence of viscosity contrast. They have to be extended by including the viscosity ratio in the inversion procedure.

The results of processing optical monitoring data shown in FIGS. 11A and 11B are given below in Table 1. The transition production volume $V_T$ used for the cleanup dynamics prediction corresponds to the identified point on the OD curve shown in FIG. 11B. The last column in Table 1 contains the value of contamination measured in the PVT Lab.

TABLE 1

Results of Cleanup Production Prediction

| $V_{BT}$, cc | $V_T$, liters | $\Omega_T$ | $d_i/r_w$ | $\log_{10}(\Omega_T)$ | $V_P$, liters | $C_{EST}$, % | $C_{Lab}$, % |
|---|---|---|---|---|---|---|---|
| 720 | 15 | 20.8 | 1.0 | 1.32 | 118 | 6.0 | 7.2 |

These results validate the new technique of cleanup production monitoring and prediction using real field data. Regarding the fact that the viscosity contrast was neglected during forward problem modeling and also that the porosity and the permeability anisotropy ratio were unknown, the presented result of cleanup dynamics prediction looks promising.

Despite reasonable predictions of final contaminations in other cases investigated, the attempts to match the initial cleanup trend $C \sim \Omega^{-5/12}$ during very early phase of cleanup have failed so far, indicating that the real flow and contamination transport patterns most probably were different from the theoretical solutions. The entire cleanup monitoring concept, however, has merits since most of the information about the flow pattern and contamination transport is available only during the initial phase of cleanup, i.e., starting from the breakthrough of formation fluid to the sampling tool to the end of circumferential cleanup. During this initial phase of cleanup, the scale of optical density variation is large, the flow pattern variation in the presence of viscosity contrast may be significant, and the forward problem solution has the highest sensitivity to the depth of mud filtrate invasion.

In contrast, during the late phase of cleanup production, the scale of optical density variation becomes very small and the flow and contamination transport patterns change very slowly. All this makes it extremely difficult to capture the trend of cleanup dynamics and to perform the inversion of cleanup monitoring data. It also takes much longer time to acquire enough data for history matching.

At the same time, the reservoir volume involved in cleanup monitoring is also expanding with time, increasing the uncertainty about the flow pattern and contamination transport due to possible presence of large scale inhomogeneities represented, for example, by laminations, fractures, impermeable barriers, and reservoir boundaries. The adequate modeling of flow and contamination transport under these circumstances and the level of uncertainty becomes more difficult if not impossible.

The advanced history matching technique developed in well testing for the pressure buildup analysis provides a powerful means for the interpretation of well testing data. The developed special type curves, which are based on the logarithmic pressure derivative plots, allow for capturing and recognition of different features of flow patterns created during formation testing. It may be advantageous to apply this technique for the interpretation of the optical density logs obtained during cleanup production.

Using Eq. (2), the relationship between the measured optical density of produced fluid OD(t) and the unknown contamination $\eta(t)$ can be expressed as:

$$\Phi(t)=\Phi_0[1-\eta(t)] \tag{6}$$

$$\Phi(t)=OD(t)-OD_F,\ \Phi_0=OD_O-OD_F$$

Here, $\Phi_0$ represents the full OD contrast and $\Phi(t)$ is the current OD contrast between the mud filtrate and the produced mixture. The parameter $\Phi_0$ is unknown since it depends on the unknown OD of formation fluid, $OD_O$. The current OD contrast, $\Phi(t)$, can be measured directly or estimated during cleanup production provided the optical density of OBM filtrate, $OD_F$, becomes known.

Taking the logarithm of both parts of Eq. (6) and then differentiating the result, one obtains the relationship between the contamination $\eta(t)$ and the measured OD contrast, $\Phi(t)$, which can be represented in the factorized form:

$$\frac{\Phi'(t)}{\Phi(t)} = -\frac{\eta'(t)}{1-\eta(t)} \tag{7}$$

Here, the prime (') means the time derivative. For variable production rate during cleanup, the time t has to be replaced by the produced volume V.

If the solution for the problem of flow and contamination transport during cleanup production is known, both the function $\eta(t)$ and its derivative $\eta'(t)$ can be calculated. This means that the function in the right hand side of Eq. (7) also can be calculated. Thus, Eq. (7) may potentially provide the foundation for the interpretation and inversion of optical data obtained during cleanup monitoring. This could be achieved by fitting the right hand side of Eq. (7), representing the theoretical solution, to the measured function $\Phi'(t)/\Phi(t)$ in the left hand side of this equation. The list of fitting parameters should involve all the unknowns, such as the depth of OBM filtrate invasion, the permeability anisotropy ratio, the viscosity contrast, and others, if their effects on the solutions can be quantified.

Experience, however, indicates that the outlined approach, based on the history matching, has slim chances for success in real life, e.g., for the monitoring sampling from reservoirs with natural variability of their flow properties. The explanation for this lies in the fundamental differences in physics of two phenomena, the pressure wave propagation and the contamination transport by flow in porous media, which are reflected by their governing equations. The pressure buildup in the formation is controlled by the diffusion-type parabolic equation having a tendency to average and smooth the reservoir response in presence of inhomogeneity of its flow properties. In contrast, the contamination transport in large scale is governed by the wave-type hyperbolic equation having long memory of flow pattern irregularities, which are induced by a natural reservoir inhomogeneity. This potentially results in significant deviations of the optical density measured during cleanup production from the theoretical solutions obtained for homogeneous formations or formations with known regular variation of flow properties. The approach based on the differentiation of optical density logs, tested against multiple field data sets, does not manifest robustness and often leads to significant interpretation errors. The factors contributing to the cleanup monitoring challenges include the flow pattern uncertainty, the strong sensitivity of contamination transport to multiscale inhomogeneity, unknown OD contrast, noisiness of OD logs, and time constraints.

In view of the above and the Figures, those skilled in the art should recognize that the present disclosure introduces a method of formation evaluation comprising lowering a sampling tool into a wellbore penetration a subterranean formation, establishing fluid communication with the formation, and estimating a depth of invasion. A cleanup model is then selected based on the estimated invasion, and the cleanup model is used to determine a sample fluid related parameter. Estimating the depth of invasion may include detecting a breakthrough volume. The sample fluid related parameter may be at least one of a contamination level and a pump out volume to achieve a contamination target. Selecting the cleanup model based on the estimated invasion may include selecting between a substantially circumferential cleanup model and a substantially vertical cleanup model. Selecting a cleanup model based on the estimated invasion may include detecting a transition from a substantially circumferential cleanup regime to a substantially vertical cleanup regime. Using the cleanup model to determine the sample fluid related parameter may include modifying the estimated depth of invasion.

The present disclosure also introduces a method of formation evaluation comprising lowering a sampling tool into a wellbore penetration a subterranean formation, establishing fluid communication between the formation and a sample tool, detecting breakthrough of formation fluid to the sampling tool, and detecting transition of cleanup regime from a predominantly circumferential cleanup regime to a predominantly vertical cleanup regime. Such method may further comprise characterizing flow and contamination transport patterns in the formation based on the breakthrough detection and the transition detection. The method may further comprise estimating an initial depth of invasion prior to detecting the breakthrough and the transition. Estimating the initial depth of invasion may be performed in the absence of viscosity contrast. The method may further comprise reconstructing the initial depth of invasion after detecting the breakthrough and the transition based on the detected breakthrough and transition. Reconstructing the initial depth of invasion may be performed in the absence of viscosity contrast.

The present disclosure also introduces a method of cleanup monitoring and prediction in real time targeting estimation of pumpout volume versus final contamination, comprising determining a breakthrough production volume, detecting a first production volume corresponding to transition of a first cleanup regime to a second cleanup regime, and determining a first normalized production volume corresponding to the cleanup regime transition, wherein determining the first normalized production volume is based on the breakthrough production volume and the first production volume. A first invasion depth estimate corresponding to the first normalized production volume is then determined. A second normalized production volume corresponding to a predetermined contamination target is then determined, wherein determining the second normalized production volume is based on the estimated first invasion depth. A second production volume corresponding to the contamination target is then determined, wherein determining the second production volume is based on the second normalized production volume and the breakthrough production volume. The first cleanup regime may be a predominantly circumferential regime and the second cleanup regime may be a predominantly vertical regime. Determining the first invasion depth estimate corresponding to the first normalized production volume may include determining a logarithmic relation between the first normalized production volume and the ratio of invasion depth to wellbore radius.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

Nomenclature used herein includes:

a, b=fitting parameters
B=coefficient in approximate cleanup solution
c=filtrate concentration
C=filtrate contamination, %
$C_{EST}$=estimated filtrate contamination, %
$C_{Lab}$=filtrate contamination measured in PVT Lab, %
$d_i$=depth of invasion
$k_H$=horizontal permeability
$k_V$=vertical permeability
OD=optical density
$OD_F$=optical density of OBM filtrate
$OD_O$=optical density of virgin formation fluid
$r_P$=probe radius
$r_S$=radius of simulation domain
$r_w$=wellbore radius
t=time
V=pumpout volume
$V_{BT}$=breakthrough volume
$V_P$=production volume
$V_T$=pumpout volume at cleanup regime transition
$\alpha$=exponent in approximate cleanup solution
$\delta$=dimensionless depth of invasion
$\phi$=porosity
$\Phi$=optical density contrast
$\Phi_0$=OD contrast between virgin formation fluid and OBM filtrate
$\eta$=contamination
$\eta_0$=contamination target
$\Omega$=dimensionless pumpout volume
$\Omega_P$=dimensionless production volume
$\Omega_T$=dimensionless pumpout volume at cleanup regime transition

What is claimed is:

1. A method of formation evaluation, comprising lowering a sampling tool into a wellbore penetration a subterranean formation; establishing fluid communication with the formation; estimating, via a computer, a depth of invasion based on a normalized production volume, wherein the normalized production volume comprises a ratio between a first production volume, representing a transition between first and second cleanup regimes, and a breakthrough volume; selecting a cleanup model based on the estimated invasion; and using the cleanup model to determine a sample fluid related parameter.

2. The method of claim 1 wherein estimating the depth of invasion includes detecting the breakthrough production volume.

3. The method of claim 1 wherein the sample fluid related parameter is at least one of a contamination level and a pump out volume to achieve a contamination target.

4. The method of claim 1 wherein selecting the cleanup model based on the estimated invasion includes selecting between a substantially circumferential cleanup model and a substantially vertical cleanup model.

5. The method of claim 1 wherein using the cleanup model to determine the sample fluid related parameter includes modifying the estimated depth of invasion.

6. A method of formation evaluation, comprising: lowering a sampling tool into a wellbore penetration a subterranean formation; establishing fluid communication between the formation and a sample tool; detecting breakthrough of formation fluid to the sampling tool; and detecting transition of cleanup regime from a predominantly circumferential cleanup regime to a predominantly vertical cleanup regime; and estimating, via a computer, an initial depth of invasion prior to detecting the breakthrough and the transition, wherein estimating an initial depth of invasion is performed in the absence of viscosity contrast.

7. The method of claim 6 further comprising characterizing flow and contamination transport patterns in the formation based on the breakthrough detection and the transition detection.

8. The method of claim 6 further comprising reconstructing the initial depth of invasion after detecting the breakthrough and the transition based on the detected breakthrough and transition.

9. The method of claim 8 wherein reconstructing the initial depth of invasion is performed in the absence of viscosity contrast.

10. A method of cleanup monitoring and prediction in real time targeting estimation of pumpout volume versus final contamination, comprising:

determining a breakout production volume;

detecting a first production volume corresponding to transition of a first cleanup regime to a second cleanup regime;

determining, via a computer, a first normalized production volume corresponding to the cleanup regime transition, wherein determining the first normalized production volume is based on the breakthrough production volume and the first production volume;

determining, via the computer, a first invasion depth estimate corresponding to the first normalized production volume;

determining, via the computer, a second normalized production volume corresponding to a predetermined contamination target, wherein determining the second normalized production volume is based on the estimated first invasion depth; and determining, via the computer, a second production volume corresponding to the contamination target, wherein determining the second production volume is based on the second normalized production volume and the breakthrough production volume.

11. The method of claim 10 wherein the first cleanup regime is a predominantly circumferential regime and the second cleanup regime is a predominantly vertical regime.

12. The method of claim 10 wherein determining the first invasion depth estimate corresponding to the first normalized production volume includes determining a logarithmic relation between the first normalized production volume and the ratio of invasion depth to wellbore radius.

13. The method of claim 1 wherein the first cleanup regime is a predominantly circumferential regime and the second cleanup regime is a predominantly vertical regime.

14. The method of claim 1 wherein the breakthrough production volume represents a pump out volume that achieves a breakthrough of the sample fluid to the sampling tool.

15. The method of claim 1, wherein the sampling tool comprises a drill bit.

16. The method of claim 1, wherein estimating a depth of invasion is performed in the absence of viscosity contrast.

17. The method of claim 6, wherein the sampling tool comprises a drill bit.

* * * * *